US009906866B2

(12) United States Patent
Mao et al.

(10) Patent No.: US 9,906,866 B2
(45) Date of Patent: Feb. 27, 2018

(54) MINIATURE SPEAKER

(71) Applicants: Lubin Mao, Shenzhen (CN); Wei Song, Shenzhen (CN); Hongxing Wang, Shenzhen (CN); Rongguan Zhou, Shenzhen (CN)

(72) Inventors: Lubin Mao, Shenzhen (CN); Wei Song, Shenzhen (CN); Hongxing Wang, Shenzhen (CN); Rongguan Zhou, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 15/413,683

(22) Filed: Jan. 24, 2017

(65) Prior Publication Data

US 2018/0027332 A1 Jan. 25, 2018

(30) Foreign Application Priority Data

Jul. 20, 2016 (CN) ..... 2016 2 0770290 U

(51) Int. Cl.

| | |
|---|---|
| ***H04R 9/02*** | (2006.01) |
| ***H04R 7/12*** | (2006.01) |
| ***H04R 9/06*** | (2006.01) |
| *H04R 31/00* | (2006.01) |

(52) U.S. Cl.

CPC ..... *H04R 9/025* (2013.01); *H04R 7/127* (2013.01); *H04R 9/06* (2013.01); *H04R 31/006* (2013.01); *H04R 2400/11* (2013.01)

(58) Field of Classification Search

CPC ..... H04R 9/00; H04R 9/025; H04R 9/027

USPC ..... 381/396, 412–414, 417–421

See application file for complete search history.

(56) References Cited

U.S. PATENT DOCUMENTS

| | | | | |
|---|---|---|---|---|
| 8,270,661 | B2 * | 9/2012 | Sorensen | H04R 9/063 381/401 |
| 8,385,581 | B2 * | 2/2013 | Li | H04R 9/06 381/401 |
| 8,649,550 | B2 * | 2/2014 | Shi | H01F 7/0289 381/412 |
| 8,660,292 | B2 * | 2/2014 | Li | H02K 33/16 381/396 |
| 8,781,150 | B2 * | 7/2014 | Babb | H04R 9/022 381/397 |
| 2008/0317276 | A1 * | 12/2008 | Sorensen | H04R 9/063 381/401 |
| 2012/0008816 | A1 * | 1/2012 | Liu | H04R 9/063 381/401 |

(Continued)

*Primary Examiner* — Suhan Ni

(74) *Attorney, Agent, or Firm* — IPro, PLLC; Na Xu

(57) ABSTRACT

A miniature speaker includes a frame having a base plate, a cover plate covering the frame and forming an accommodating space; a vibrating system fixed on the frame; and a magnetic circuit system for driving the vibrating system to vibrate. The magnetic circuit system includes a main magnet, a first pole plate attached to the main magnet, and two first side magnet components. Each of the first side magnet components includes a first side magnet, a second pole plate and a second side magnet stacked sequentially from the base plate along a direction toward the cover plate. A magnetizing direction of the first side magnet is opposite to that of the main magnet, and a magnetizing direction of the second side magnet is opposite to that of the first side magnet.

10 Claims, 4 Drawing Sheets

(56) References Cited

U.S. PATENT DOCUMENTS

2014/0056465 A1* 2/2014 Li ..... H04R 9/025
381/400
2015/0365768 A1* 12/2015 Andersen ..... H04R 9/06
381/421

* cited by examiner

MINIATURE SPEAKER

FIELD OF THE INVENTION

The invention is related to electro-acoustic transducers, more particularly to a miniature speaker used in a portable consumer device.

DESCRIPTION OF RELATED ART

With the coming of mobile internet times, the quantity of intelligent mobile device is rising continuously. Among many mobile equipment, mobile phone is the most common and portable mobile terminal equipment. At present, the function of mobile phone is diversified. One of important functions is that of high quality music, and the miniature speaker in mobile phone is one of the essential conditions of realizing the function of high quality music.

The miniature speaker of relevant technology comprises a magnetic circuit system having a main magnet and a side magnet, wherein the main magnet and the side magnet are subjected to magnetization in vertical direction, and soft-magnetic material are applied to magnetism gathering. However, the efficiency of the magnetic circuit of such magnetic circuit system is not desirable and cannot satisfy users' requirements for better sound performance.

Therefore, it is necessary to provide an improved miniature speaker to overcome above disadvantage.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Figure 1:
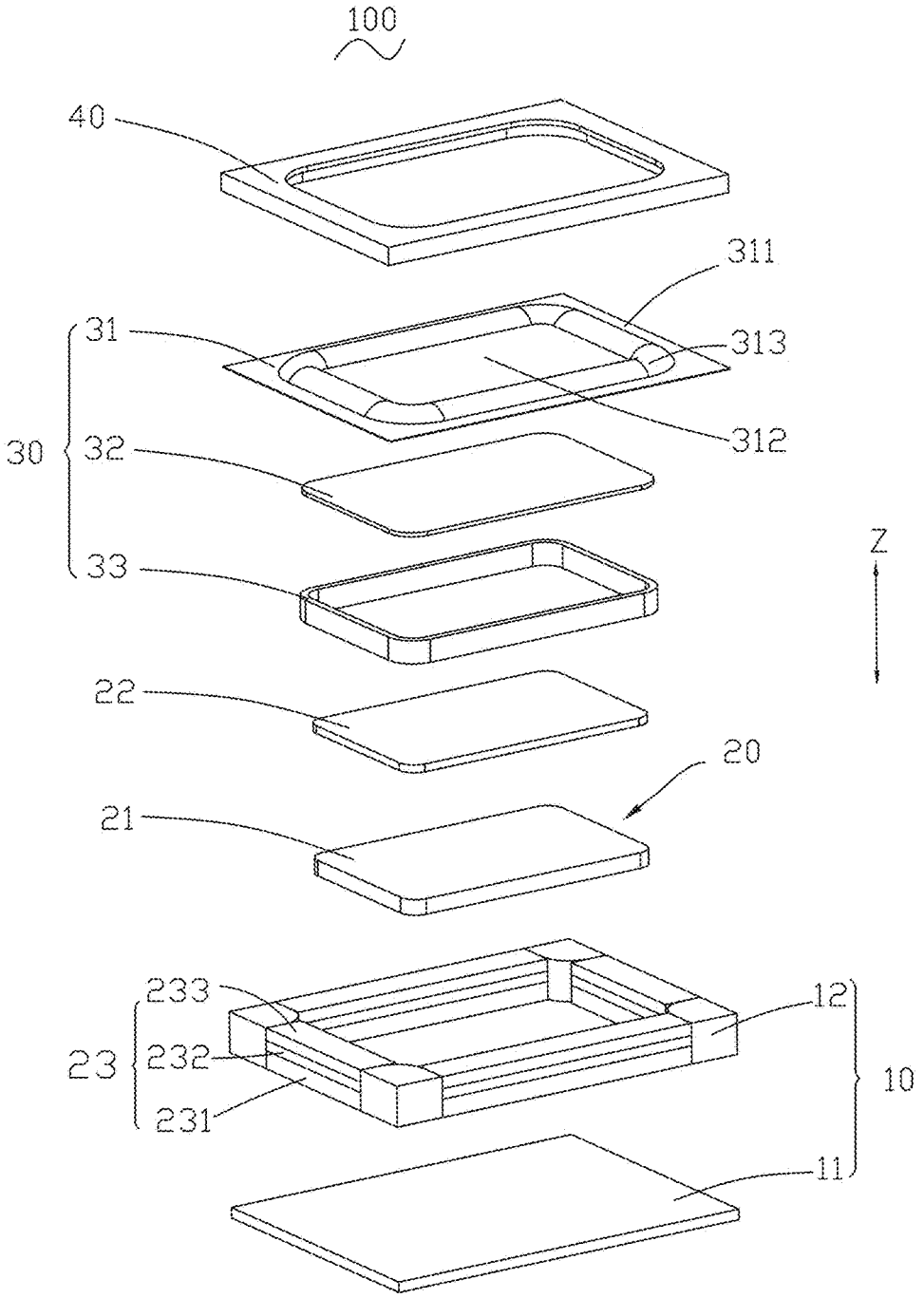
FIG. 1 is an isometric and exploded view of a miniature speaker in accordance with a first exemplary embodiment of the present disclosure.
Figure 2:
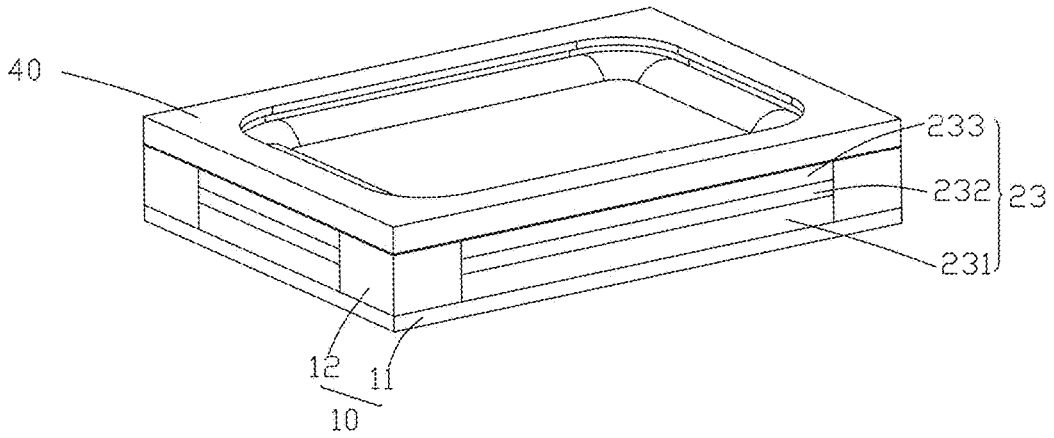
FIG. 2 is an assembled view of the miniature speaker in FIG. 1.

The present invention will hereinafter be described in detail with reference to several exemplary embodiments. To make the technical problems to be solved, technical solutions and beneficial effects of the present disclosure more apparent, the present disclosure is described in further detail together with the figures and the embodiments. It should be understood the specific embodiments described hereby are only to explain this disclosure, not intended to limit this disclosure.

Embodiment 1

A miniature speaker 100 comprises a frame 10, a cover plate 40 engaging with the frame 10 for forming an accommodating space, a magnetic circuit system 20 accommodated in the accommodating space, and a vibrating system 30 fixed on the frame 10 and accommodated in the accommodating space partially. The magnetic circuit system 20 is applied to generate magnetic field; while the vibrating system 30 produces sound when generating vibration in presence of drive force of the magnetic field generated by the magnetic circuit system 20.

The frame 10 can be a plastic frame, or a yoke. As shown in FIGS. 1-4, the frame 10 specifically comprises a base plate 11 and multiple connecting pieces 12 which are arranged on the base plate 1, wherein the base plate 11 is presented as a rectangle flat plate, and multiple connecting pieces 12 are arranged at each corner of the rectangle base plate 11 in order to fix multiple first side magnet components 23 in the magnetic circuit system 20. In this embodiment, the base plate 11 is fabricated from the permeability magnetic material preferably, playing a role of magnetic conduction. Of course, the base plate 11 and the connecting piece 12 can also be fabricated from the plastics in other embodiments, and the base plate 11 and the connecting piece 12 are formed integrally.

Figure 3:
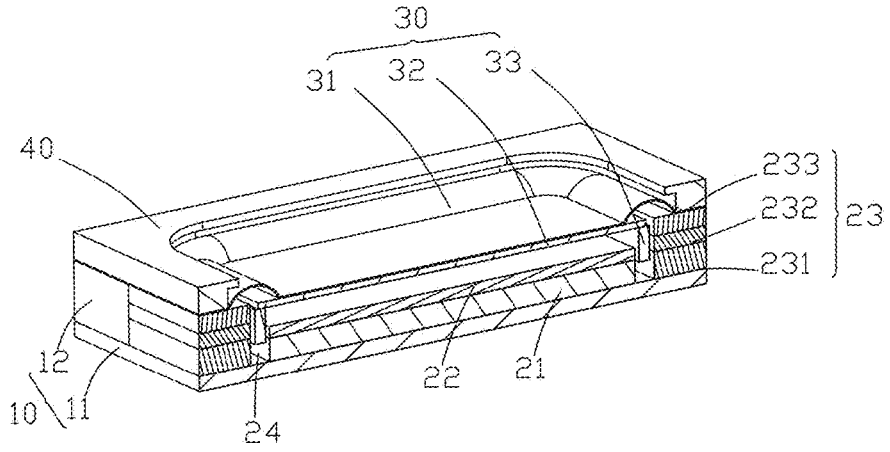
FIG. 3 is a cross-sectional view of the miniature speaker in FIG. 2.
Figure 4:
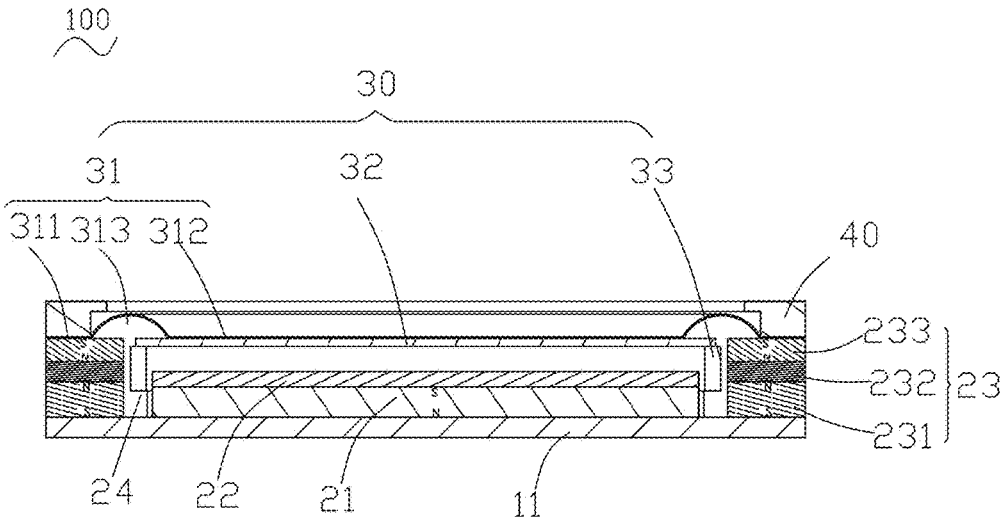
FIG. 4 is another cross-sectional view of the miniature speaker in FIG. 2.

Referring to FIGS. 1, and 3-4, the magnetic circuit system 20 comprises a main magnet 21 which is fixed on at the middle part of the base plate 11, a first pole plate 22 which is adhered to the main magnet 21's surface facing the cover plate 40 and multiple first side magnet components 23 which are fixed on the edge of the base plate 11 in the embodiment 1, wherein a magnetic gap 24 is formed between the main magnet 21 and multiple first side magnet components 23; and a voice coil 33 of the vibrating system 30 is inserted into the magnetic gap 24. Each of the first side magnet components 23 comprises a first side magnet 231, a second pole plate 232 and a second side magnet 233 which are stacked sequentially from the base plate 11 along the direction toward the cover plate 40. In this embodiment, the main magnet 21 is magnetized along the vertical direction (the direction vertical to the base plate 11, that is, the direction Z in FIG. 1). The magnetizing direction of the first side magnet 231 is opposite to that of the main magnet 21, and the magnetizing direction of the second side magnet 233 is opposite to that of the first side magnet 231, that is, the magnetizing direction of the second side magnet 233 is the same as that of the main magnet 21.

The magnetic circuit system of the miniature speaker as shown in FIG. 1 is the system having five magnetic circuits, and four first side magnet components 23, wherein two first side magnet components 23 are arranged on two opposite side surfaces of the main magnet 21 symmetrically, and another two first side magnet components 23 are arranged on another two opposite side surfaces of the main magnet 21 symmetrically.

As shown in FIGS. 1-4, two adjacent first side magnet components 23 are connected and fixed by means of one connecting piece 12 in this embodiment. The first side magnet components 23 are connected with corresponding connecting pieces 12 by means of gluing in this embodiment. However, the complementary matching structure can be formed between two ends of the first side magnet components 23 and the adjacent connecting pieces 12 in accordance with other embodiments of the present disclosure; therefore, the connecting strength between the first side magnet components 23 and the connecting pieces 12 can be strengthened. The complementary matching structure comprises but is not limited to an inserting part and a slot; for example, the inserting parts are arranged on two ends of the first side magnets 231, the second pole plates 232 and the second side magnets 233 of the first side magnet components 23, respectively; and the slots are arranged on the connecting pieces correspondingly. Preferably, the external surface of each first side magnet component 23 is aligned with the external surfaces of the connecting pieces 12 on two ends; thus, the acoustic performance of the miniature speaker can be improved.

Magnetic poles of the main magnet 21, the first side magnets 231 and the second side magnets 233 in the embodiment 1 are shown in FIG. 4. The magnetic pole of the main magnet 21 which is positioned at the lower side (that is, one side close to the base plate 11) along the vertical direction is taken as the pole N, and the magnetic pole of the upper side (that is, one side far away from the base plate 11) is taken as the pole S; the magnetic pole of the first side magnet 231 which is positioned at the lower side (that is, one side close to the base plate 11) along the vertical direction is taken as the pole S, and the magnetic pole of the upper side (that is, one side far away from the base plate 11) is taken as the pole N; the magnetic pole of the second side magnet 233 which is positioned at the lower side (that is, one side close to the second pole plate 32) along the vertical direction is taken as the pole N, and the magnetic pole of the upper side is taken as the pole S.

The BL value can be increased greatly because the magnetic field intensity of the magnetic gap 24 where the voice coil 33 is positioned is improved greatly as a result of the first side magnet components 23 arranged in the embodiment and including the first side magnets 231 and the second side magnets 233 with magnetizing direction opposite to that of the first side magnets 231. Thus, with same input voltage, the miniature speaker of the present disclosure can have better sensitivity for sound.

Further as shown in FIGS. 1-4, the vibrating system 30 comprises a diaphragm 31, a dome 32 and a voice coil 33 which are overlapped from top to bottom and drive the diaphragm 31 to vibrate and sound in this embodiment, and the voice coil 33 is inserted into the magnetic gap 24 of the magnetic circuit system 20. Therefore, the voice coil 33 of the vibrating system can give out sound by means of vibration in the way of driving the dome 32 to vibrate and driving the diaphragm 31 to vibrate. In this embodiment, the diaphragm 31 and the dome 32, as well as the dome 32 and the voice coil 33 can be fixed with each other, for example, by means of gluing preferably.

Specifically as shown in FIGS. 1-4, the diaphragm 31 generally comprises a fixation part 311 which is positioned on an edge of the diaphragm, a vibrating main body part 312 which is positioned at the center of the diaphragm and presented as a flat plate in general and a suspension part 313 which extends from the periphery of the vibrating main body part 312 and positioned between the fixation part 311 and the vibrating main body part 312, wherein the fixation part 311 is adhered to be place between the cover plate 40 and the connecting piece 12. In the embodiment, the two ends of the dome 32 extend to the place under the suspension part 313, that is, the project of the dome 32 on the base plate 11 is overlapped with the projection of the suspension 313 on the base plate 11 partially; therefore, the voice coil 33 which is fixed under the dome 32 can be closer to the first side magnet component 23 of the magnetic circuit system 20, and more magnetic lines of force generated by the first side magnet component 23 can pass through the voice coil 33. Of course, the dome 32 also can be arranged over the diaphragm 31, and preferably positioned on the vibrating main body part 312 in other embodiments of the present disclosure.

Embodiment 2

Figure 5:
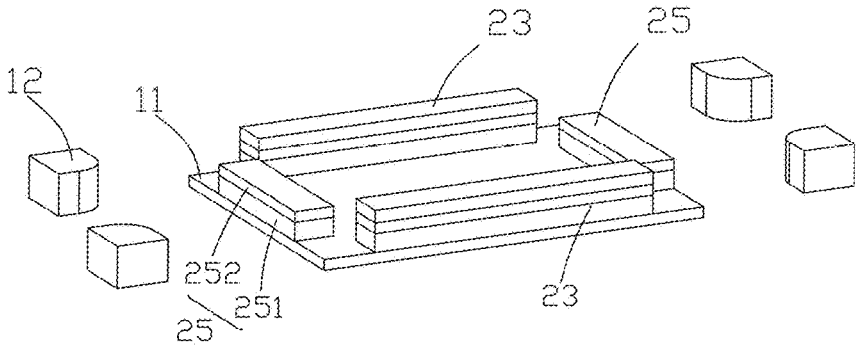
FIG. 5 is an exploded view of a combination of a frame and a side magnet component of the miniature speaker in accordance with a second exemplary embodiment.

Referring to FIG. 5, the difference from the first embodiment is that only two first side magnet components 23 are arranged, wherein the two first side magnet components 23 are arranged symmetrically on two opposite side surfaces of the main magnet 21 along the length direction of the base plate 11.

Two second side magnet components 25 are arranged symmetrically on two opposite side surfaces of the main magnet 21 along the width direction of the base plate 11. In this embodiment, each of the second side magnet components 25 comprises only the third side magnets 251 and the third pole plates 252 which are stacked from the base plate 11 along the direction pointing to the cover plate 40, wherein the magnetizing direction of the third side magnet 251 is opposite to that of the main magnet 21.

In this embodiment, each of the first side magnet components 23 and the adjacent second side magnet components 25 are connected and fixed together by means of the connecting pieces 12.

Embodiment 3

Figure 6:
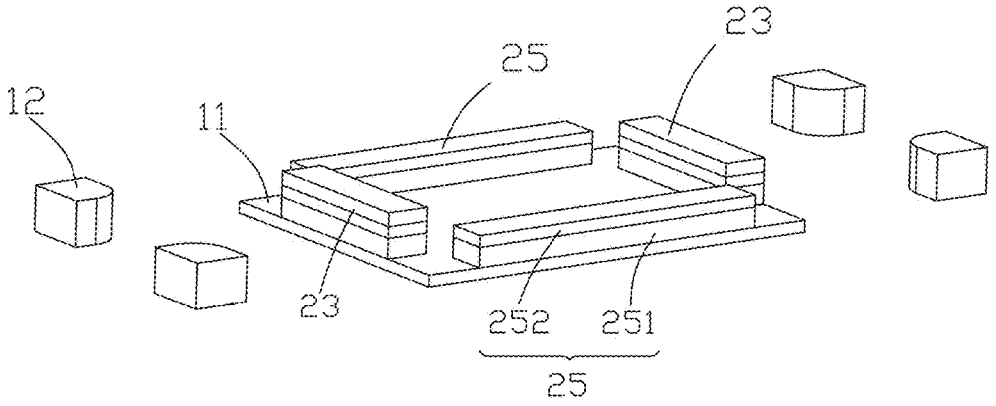
FIG. 6 is an exploded view of a combination of a frame and a side magnet component of the miniature speaker in accordance with a third exemplary embodiment.

Referring to FIG. 6, the difference is that the two first side magnet components 23 are arranged symmetrically on two opposite side surfaces of the main magnet 21 along the width direction of the base plate 11, while two second side magnet components 25 are arranged symmetrically on two opposite side surfaces of main magnet 21 along the length direction of the base plate 11.

Embodiment 4

Figure 7:
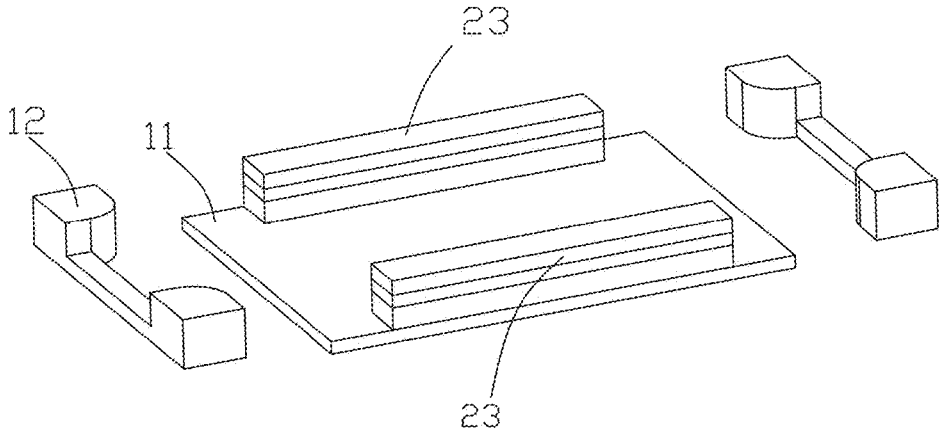
FIG. 7 is an exploded view of a combination of a frame and a side magnet component of the miniature speaker in accordance with a fourth exemplary embodiment.

Referring to FIG. 7, the difference is that the magnetic circuit system of the miniature speaker has three magnetic circuits, and two first side magnet components 23 are arranged only in this embodiment, wherein the two first side magnet components 23 are arranged symmetrically on two opposite side surfaces of the main magnet 21. In this embodiment, the two first side magnet components 23 are arranged symmetrically on two opposite side surfaces of main magnet 21 along the length direction of the base plate 11. At this time, the first connecting piece 12 extends along the width direction of the base plate 11 and connects with two first side magnet components 23.

The BL value can be increased greatly because the magnetic field intensity of the magnetic gap 24 where the voice coil 33 is positioned is improved greatly as a result of the first side magnet component 23 arranged in the miniature speaker 100 of the present disclosure and the first side magnet component 23 includes the first side magnet 231 and the second side magnet 233 having magnetizing direction opposite to that of the first side magnet 231. Thus, with same input voltage, the miniature speaker of the present disclosure can have better sensitivity for sound.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A miniature speaker, including:

a frame having a base plate, a cover plate covering the frame and forming an accommodating space;

a vibrating system fixed on the frame;

a magnetic circuit system for driving the vibrating system to vibrate, the magnetic circuit system including a main magnet fixed on the base plate, a first pole plate attached to the main magnet, two first side magnet components arranged on two opposite side surfaces of the main magnet symmetrically; each of the first side magnet components comprising a first side magnet, a second pole plate and a second side magnet stacked sequentially from the base plate along a direction toward the cover plate; wherein a magnetizing direction of the first side magnet is opposite to that of the main magnet, and a magnetizing direction of the second side magnet is opposite to that of the first side magnet.

2. The miniature speaker as described in claim 1, wherein the magnetic circuit system further comprises two first side magnet components arranged on another two opposite side surfaces of the main magnet symmetrically.

3. The miniature speaker as described in claim 1, wherein the frame further comprises multiple connecting pieces disposed on the base plat for connecting two adjacent first side magnet components.

4. The miniature speaker as described in claim 3, wherein the first side magnet component connects with the adjacent connecting piece.

5. The miniature speaker as described in claim 3, wherein a complementary and matching structure is formed by the first side magnet component and the adjacent connecting piece.

6. The miniature speaker as described in claim 3, wherein the magnetic circuit system further comprises two second side magnet components arranged on another two opposite side surfaces of the main magnet symmetrically; and each of the second side magnet components comprises a third side magnet and a third pole plate stacked sequentially from the base plate along the direction toward the cover plate; the magnetizing direction of the third side magnet is opposite to that of the main magnet.

7. The miniature speaker as described in claim 3, wherein the frame further comprises multiple connecting pieces which are arranged on the base plate at interval; each of the first side magnet components is connected with the adjacent second side magnet component fixedly by using the connecting pieces.

8. The miniature speaker as described in claim 3, wherein a magnetic conducting plate serves as the base plate.

9. The miniature speaker as described in claim 3, wherein the vibrating system comprises a diaphragm, a dome and a voice coil for driving the diaphragm.

10. The miniature speaker as described in claim 3, wherein the diaphragm comprises a fixing part, a vibrating main body part and a suspension part extending from a periphery of the vibrating main body part and positioned between the fixing part and the vibrating main body part; a projection of the dome on the base plate is partially overlapped with a projection of the suspension part on the base plate.

* * * * *